US007204174B1

(12) United States Patent
Wood

(10) Patent No.: US 7,204,174 B1
(45) Date of Patent: Apr. 17, 2007

(54) WRENCH ASSEMBLY

(76) Inventor: Rod H. Wood, 637 B S. Broadway Box 345, Boulder, CO (US) 80305

( * ) Notice: Subject to any disclaimer, the term of this patent is extended or adjusted under 35 U.S.C. 154(b) by 10 days.

(21) Appl. No.: 11/119,161

(22) Filed: May 2, 2005

(51) Int. Cl.
*B25B 17/00* (2006.01)

(52) U.S. Cl. ..... 81/57.3; 81/57.13; 81/125

(58) Field of Classification Search ..... 81/57.12, 81/57.13, 57.14, 57.3, 57.28, 57.29, 125
See application file for complete search history.

(56) References Cited

U.S. PATENT DOCUMENTS

| | | | | | |
|---|---|---|---|---|---|
| 685,544 | A | * | 10/1901 | Weimar | 81/57.29 |
| 1,423,142 | A | * | 7/1922 | Owens | 81/57.3 |
| 1,698,618 | A | * | 1/1929 | Bigelow | 81/57.29 |
| 2,532,027 | A | * | 11/1950 | Maddox | 81/57.3 |
| 3,620,105 | A | | 11/1971 | Batten | |
| 3,821,676 | A | * | 6/1974 | Carr | 335/285 |
| 4,004,476 | A | * | 1/1977 | DeVrou | 81/177.2 |
| 4,362,072 | A | * | 12/1982 | Tillman | 81/57.29 |
| 4,718,316 | A | * | 1/1988 | Dedrick | 81/125 |
| 5,307,713 | A | * | 5/1994 | White | 81/180.1 |
| 5,339,710 | A | | 8/1994 | Deadmond et al. | |
| 5,460,062 | A | | 10/1995 | Wilson, Jr. | |
| 5,709,136 | A | | 1/1998 | Frenkel | |
| 5,927,156 | A | * | 7/1999 | Landwehr, III | 81/57.3 |
| D439,485 | S | | 3/2001 | Izumisawa | |
| 6,543,313 | B2 | | 4/2003 | Samudosky | |

FOREIGN PATENT DOCUMENTS

| | | | |
|---|---|---|---|
| WO | WO 91/10539 | * | 7/1991 |

* cited by examiner

*Primary Examiner*—D. S. Meislin

(57) ABSTRACT

A wrench assembly a housing that has a top wall, a bottom wall and peripheral wall extending between and attached to the top and bottom walls. The top wall has an opening extending therethrough and through the bottom wall. A first gear wheel is positioned in the housing and has an aperture extending therethrough. The aperture is aligned with the opening. The aperture has a hexagonal shape. A second gear wheel is positioned in the housing and is in communication with the first gear wheel so that rotation of the second gear wheel causes rotation of the first gear wheel. A shaft has a first end attached to the second gear wheel. A fastener may be extended through the opening in the bottom wall and into the aperture so that aperture engages the fastener and is rotated by the first gear wheel when the shaft is rotated.

6 Claims, 4 Drawing Sheets

WRENCH ASSEMBLY

BACKGROUND OF THE INVENTION

1. Field of the Invention

The present invention relates to wrench devices and more particularly pertains to a new wrench device for accessing and reaching fasteners which cannot be reached by a conventional socket wrench so that they may be removed or inserted with a conventional power tool or socket wrench.

2. Description of the Prior Art

The use of wrench devices is known in the prior art. U.S. Pat. No. 3,620,105 describes a device that includes an offset driving mechanism for engaging threaded fasteners. Another type of wrench device is U.S. Pat. No. 5,709,136 which includes a socket driving assembly for rotating a socket perpendicular to a drive shaft of a tool. Yet another such device is found in U.S. Pat. No. 5,339,720 which includes a mechanism for turning a wrench socket in a manner spaced from a driving shaft mechanically coupled to the wrench socket.

While these devices fulfill their respective, particular objectives and requirements, the need remains for a device that allows a person to better access fasteners that cannot be reached by a socket wrench due an adjacent obstacle. The device should be able to rotate fasteners using conventional power tools and socket wrenches.

SUMMARY OF THE INVENTION

The present invention meets the needs presented above by generally comprising a housing that has a top wall, a bottom wall and peripheral wall extending between and attached to the top and bottom walls. The top wall has an opening extending therethrough and through the bottom wall. A first gear wheel is positioned in the housing and has an aperture extending therethrough. The aperture is aligned with the opening. The aperture has a hexagonal shape. A second gear wheel is positioned in the housing and is in communication with the first gear wheel so that rotation of the second gear wheel causes rotation of the first gear wheel. A shaft has a first end and a second end. The first end is attached to the second gear wheel. A fastener may be extended through the opening in the bottom wall and into the aperture so that aperture engages the fastener and is rotated by the first gear wheel when the shaft is rotated.

There has thus been outlined, rather broadly, the more important features of the invention in order that the detailed description thereof that follows may be better understood, and in order that the present contribution to the art may be better appreciated. There are additional features of the invention that will be described hereinafter and which will form the subject matter of the claims appended hereto.

The objects of the invention, along with the various features of novelty which characterize the invention, are pointed out with particularity in the claims annexed to and forming a part of this disclosure.

BRIEF DESCRIPTION OF THE DRAWINGS

The invention will be better understood and objects other than those set forth above will become apparent when consideration is given to the following detailed description thereof. Such description makes reference to the annexed drawings wherein.

DESCRIPTION OF THE PREFERRED EMBODIMENT

Figure 1:
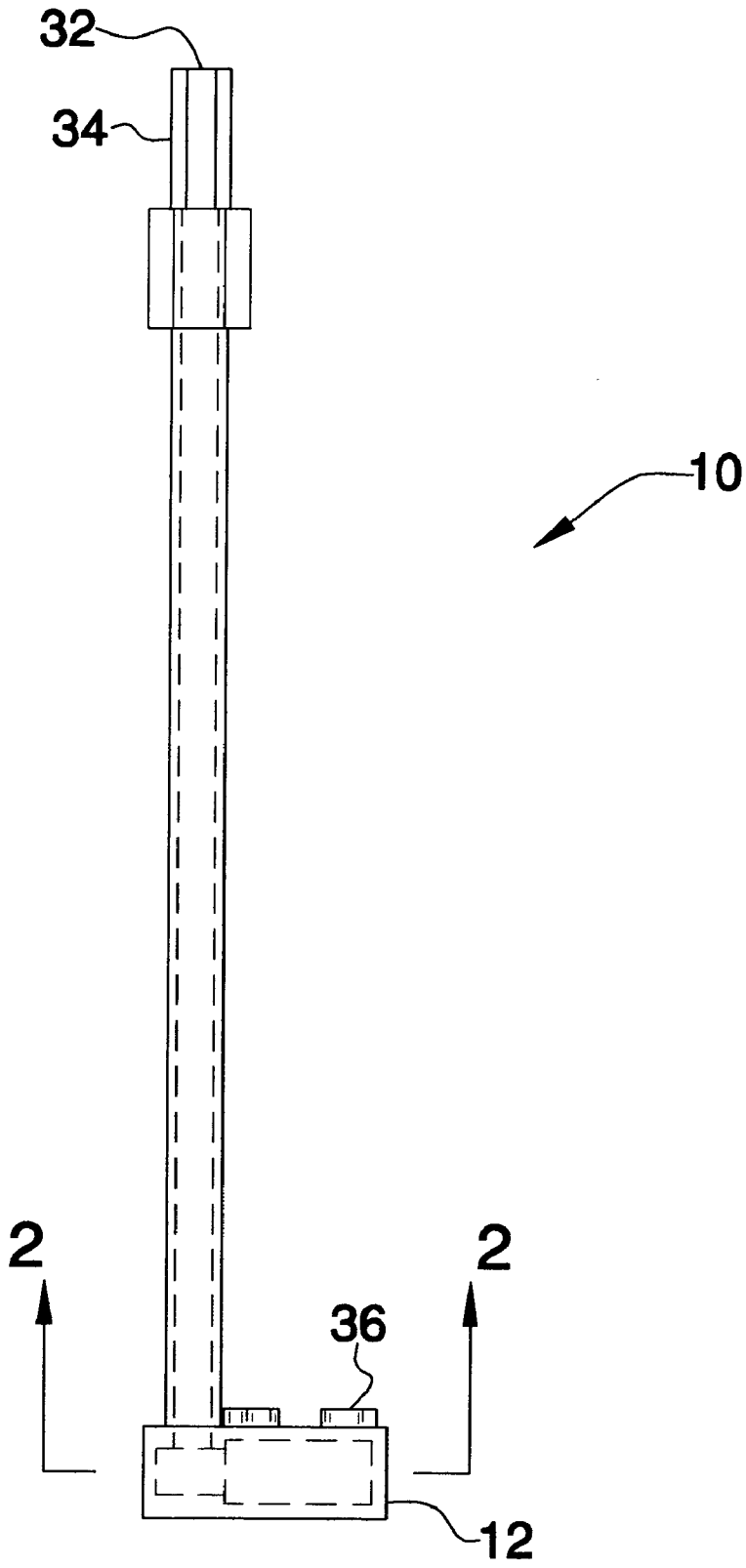
FIG. 1 is a side view of a wrench assembly according to the present invention.
Figure 2:
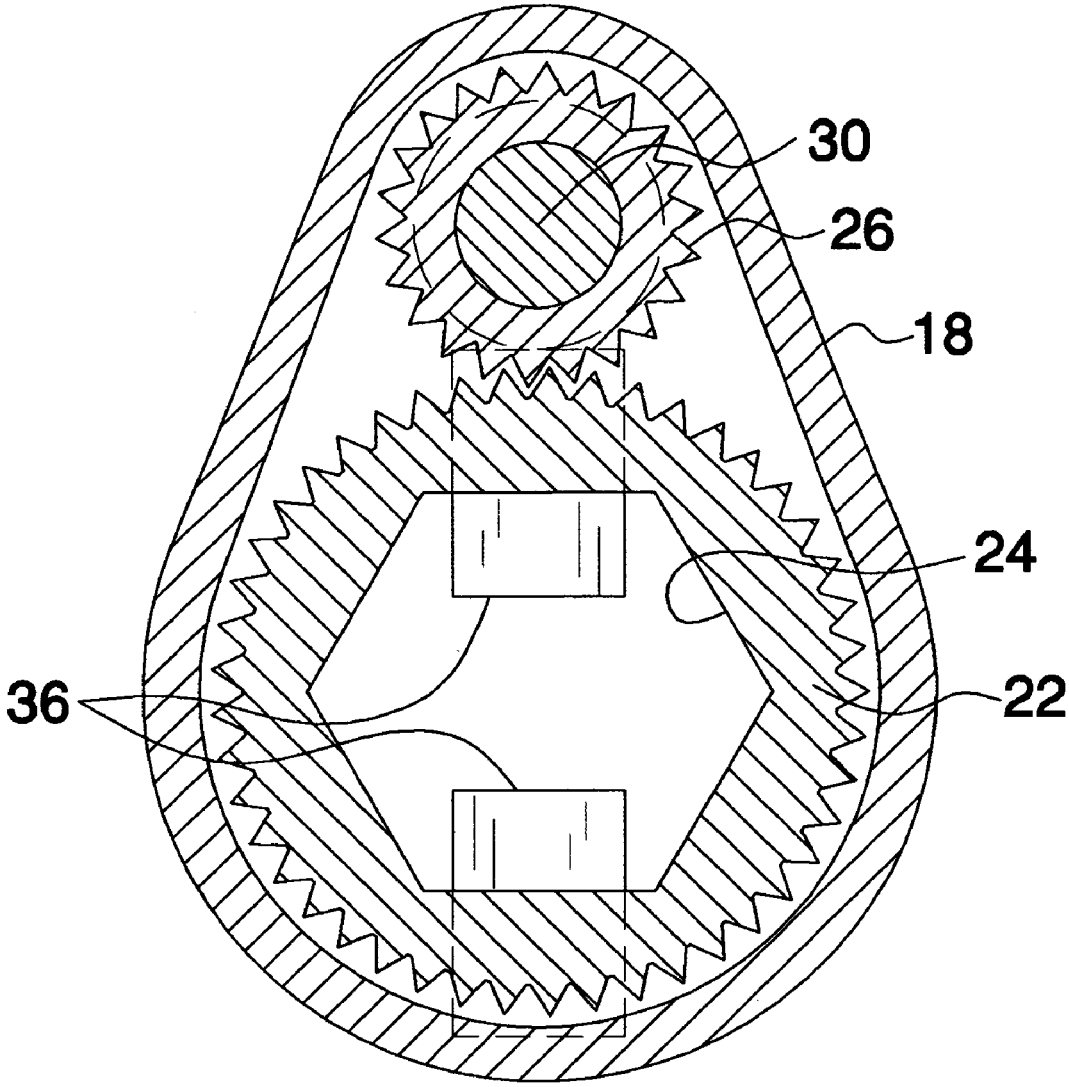
FIG. 2 is a cross-sectional view taken along line 2—2 of FIG. 1 of the present invention.
Figure 3:
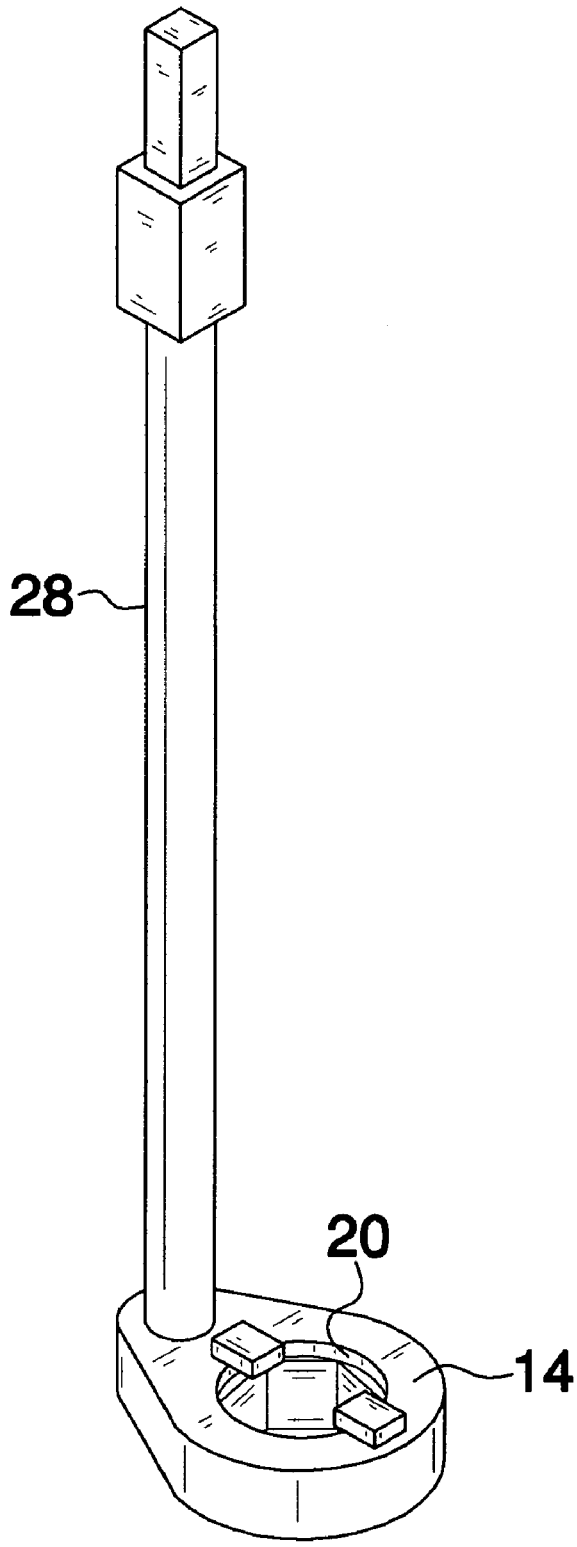
FIG. 3 is a perspective view of the present invention.
Figure 4:
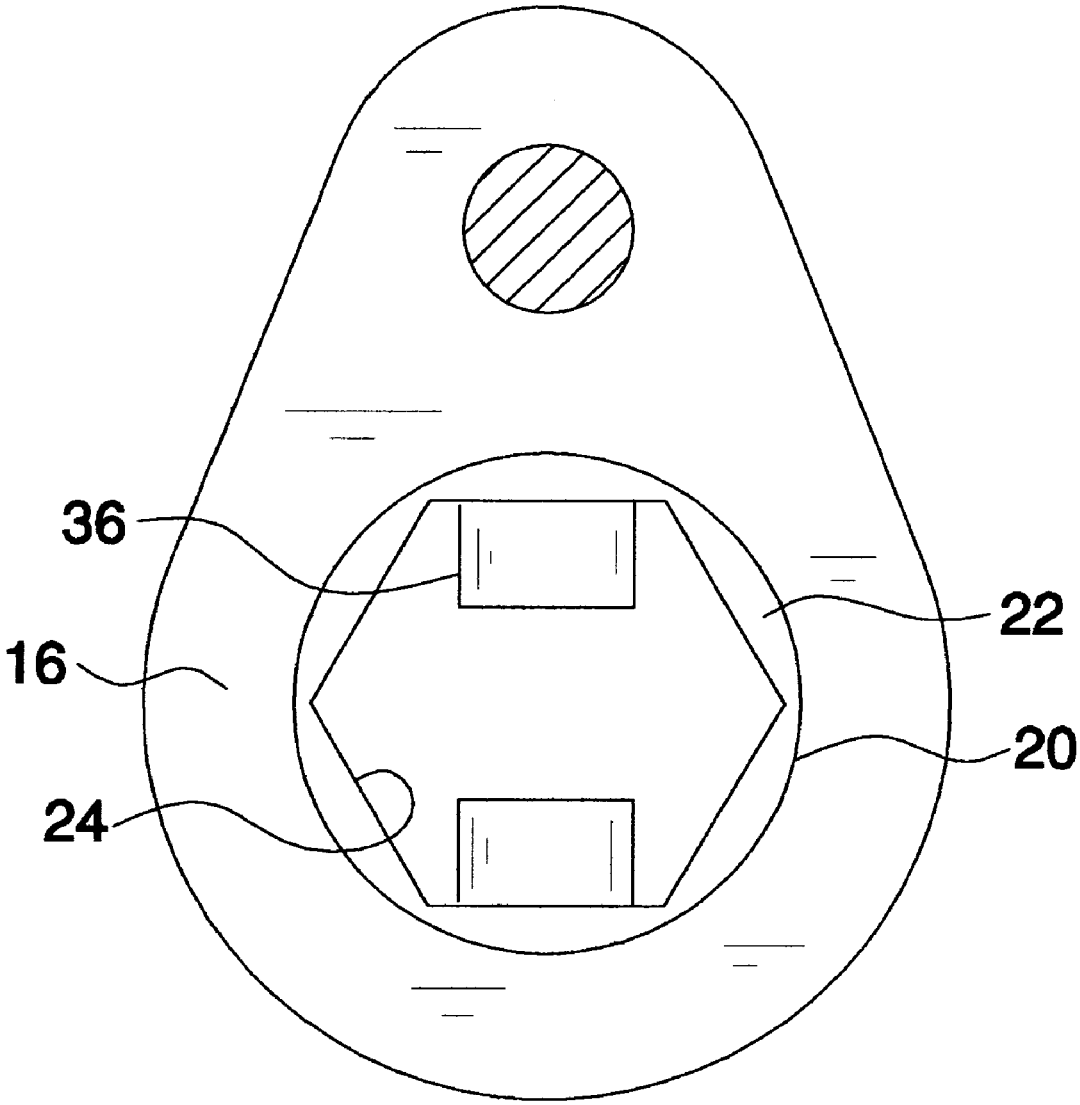
FIG. 4 is a bottom view of the present invention.

With reference now to the drawings, and in particular to FIGS. 1 through 4 thereof, a new wrench device embodying the principles and concepts of the present invention and generally designated by the reference numeral 10 will be described.

As best illustrated in FIGS. 1 through 4, the wrench assembly 10 generally comprises a housing 12 that has a top wall 14, a bottom wall 16 and peripheral wall 18 extending between and is attached to the top 14 and bottom 16 walls. The top wall 14 has an opening 20 extending therethrough and through the bottom wall 16.

A first gear wheel 22 is positioned in the housing 12 and has an aperture 24 extending therethrough. The aperture 24 is aligned with the opening 20 so that the aperture 24 is completely exposed through the bottom wall 16 while the first gear wheel 22 is rotated. The aperture 24 has a hexagonal shape.

A second gear wheel 26 is positioned in the housing 12 and is in communication with the first gear wheel 26 so that rotation of the second gear wheel 26 causes rotation of the first gear wheel 22. The first 22 and second 26 gear wheels are co-planar with respect to each other.

A shaft 28 has a first end 30 and a second end 32. The first end 30 extends through the top wall 14 and is attached to the second gear wheel 26. A longitudinal axis of the shaft 28 extends through an axis of the second gear wheel 26. The second gear wheel 26 rotates when the shaft 28 is rotated. A distal section 34 of the shaft 28 with respect to the housing 12 is non-cylindrical and preferably has a hexagonal or rectangular cross-section taken perpendicular to the longitudinal axis. The shaft 28 has a length generally between 6 inches and 12 inches.

At least one magnet 36 is attached to the top wall 14 of the housing 12. The magnet 36 extends over the opening 20. A second magnet 36 may also be attached to the top wall 14. Alternatively, the magnets 36 may be positioned within the housing 12 and embedded into the top wall 14.

In use, a fastener, such as a nut or bolt heat, may be extended through the opening 20 in the bottom wall 16 and into the aperture 24 so that aperture 24 engages the fastener and is rotated by the first gear wheel 22 when the shaft 28 is rotated. The offset nature of the shaft 28 with respect to the second gear wheel 22 allows a person to reach fasteners otherwise inaccessible with a conventional ratchet. The second end 32 of the shaft 28 may be coupled to a drill or to a socket wrench. The magnets 36 ensure that the housing 12 remains secured to the fastener.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

I claim:

1. An off-set fastener engaging apparatus comprising:

a housing having a top wall, a bottom wall and peripheral wall extending between and being attached to said top and bottom walls, said top wall having an opening extending therethrough and through said bottom wall;

a first gear wheel being positioned in said housing and having an aperture extending therethrough, said aperture being aligned with said opening, said aperture having a hexagonal shape;

a second gear wheel being positioned in said housing, said second gear wheel being in communication with said first gear wheel such that rotation of said second gear wheel causes rotation of said first gear wheel;

a shaft having a first end and a second end, said first end being attached to said second gear wheel, said first end of said shaft extending through said top wall, a longitudinal axis of said shaft extending through an axis of said second gear wheel, said first and second gear wheels being co-planar with respect to each other and said shaft being orientated perpendicular to a plane of said first and second gear wheels, a rotational axis of said first gear wheel being orientated parallel to a rotational axis of said second gear wheel;

at least one magnet being attached to said top wall of said housing, said magnet extending over said opening, said at lest one magnet extending only over a partial distance of said opening, said at least one magnet being positioned completely outside of said opening; and wherein a fastener may be extended through said opening in said bottom wall and into said aperture such that aperture engages the fastener and is rotated by said first gear wheel when said shaft is rotated.

2. The apparatus according to claim 1, wherein a distal section of said shaft with respect to said housing being non-cylindrical, a proximal section of said shaft with respect to said housing being cylindrical.

3. The apparatus according to claim 2, wherein said shaft has a length generally between 6 inches and 12 inches.

4. The apparatus according to claim 1, wherein said shaft has a length generally between 6 inches and 12 inches.

5. An off-set fastener engaging apparatus comprising:

a housing having a top wall, a bottom wall and peripheral wall extending between and being attached to said top and bottom walls, said top wall having an opening extending therethrough and through said bottom wall;

a first gear wheel being positioned in said housing and having an aperture extending therethrough, said aperture being aligned with said opening such that said aperture is completely exposed through said bottom wall, said aperture having a hexagonal shape;

a second gear wheel being positioned in said housing, said second gear wheel being in communication with said first gear wheel such that rotation of said second gear wheel causes rotation of said first gear wheel, said first and second gear wheels being co-planar with respect to each other;

a shaft having a first end and a second end, said first end extending through said top wall and being attached to said second gear wheel, a longitudinal axis of said shaft extending through an axis of said second gear wheel, said second gear wheel rotating when said shaft is rotated, a distal section of said shaft with respect to said housing being non-cylindrical, said shaft having a length generally between 6 inches and 12 inches, said shaft being orientated perpendicular to a plane of said first and second gear wheels, a rotational axis of said first gear wheel being orientated parallel to a rotational axis of said second gear wheel, a proximal section of said shaft with respect to said housing being cylindrical;

a pair of magnets each being attached to said top wall of said housing, said magnets each extending only over a partial distance of said opening, said magnets being positioned completely outside of said opening, said magnets extending toward each other, a space being defined between said magnets; and wherein a fastener may be extended through said opening in said bottom wall and into said aperture such that aperture engages the fastener and is rotated by said first gear wheel when said shaft is rotated.

6. The apparatus according to claim 5, wherein said magnets are each securely attached to said housing.

* * * * *